US007522069B2

(12) United States Patent
Tunnell et al.

(10) Patent No.: US 7,522,069 B2
(45) Date of Patent: Apr. 21, 2009

(54) VEHICLE TRIP LOGGER

(75) Inventors: Matthew Tunnell, Vancouver, WA (US); Vicki Golden-Roberts, Oregon City, OR (US); John Veneruso, Vancouver, WA (US)

(73) Assignee: VMatter Holdings, LLC, Vancouver, WA (US)

( * ) Notice: Subject to any disclaimer, the term of this patent is extended or adjusted under 35 U.S.C. 154(b) by 198 days.

(21) Appl. No.: 11/495,356

(22) Filed: Jul. 27, 2006

(65) Prior Publication Data

US 2008/0030376 A1 Feb. 7, 2008

(51) Int. Cl.
*G08G 1/123* (2006.01)

(52) U.S. Cl. ..... 340/995.19; 340/539.13; 340/995.24; 701/35; 701/208

(58) Field of Classification Search . 340/995.1–995.27, 340/539.13, 988; 701/208–213, 35; 342/357
See application file for complete search history.

(56) References Cited

U.S. PATENT DOCUMENTS

| | | | | |
|---|---|---|---|---|
| 4,875,167 | A | 10/1989 | Price et al. | |
| 5,214,757 | A | 5/1993 | Manney et al. | |
| 5,303,163 | A | 4/1994 | Ebaugh et al. | |
| 5,359,528 | A | 10/1994 | Haendel et al. | |
| 5,550,738 | A * | 8/1996 | Bailey et al. | 455/456.5 |
| 5,557,524 | A | 9/1996 | Maki | |
| 5,612,875 | A | 3/1997 | Haendel et al. | |
| 5,694,322 | A | 12/1997 | Westerlage et al. | |
| 5,794,356 | A * | 8/1998 | Raab | 33/503 |
| 5,954,773 | A | 9/1999 | Luper | |
| 5,974,356 | A | 10/1999 | Doyle et al. | |
| 6,226,577 | B1 * | 5/2001 | Yeo | 701/35 |
| 6,301,533 | B1 * | 10/2001 | Markow | 701/35 |
| 6,393,346 | B1 * | 5/2002 | Keith et al. | 701/35 |
| 6,571,168 | B1 | 5/2003 | Murphy et al. | |
| 6,650,359 | B1 | 11/2003 | Park | |
| 6,718,263 | B1 | 4/2004 | Glass et al. | |
| 6,741,933 | B1 | 5/2004 | Glass | |
| 6,856,933 | B1 | 2/2005 | Callaghan | |
| 6,885,937 | B1 | 4/2005 | Suranyi | |
| 6,961,658 | B2 | 11/2005 | Ohler | |
| 6,975,929 | B2 | 12/2005 | Maruyama | |
| 2002/0035609 | A1 | 3/2002 | Lessard et al. | |
| 2002/0072963 | A1 | 6/2002 | Jonge | |
| 2003/0110092 | A1 | 6/2003 | Riegler | |
| 2004/0049424 | A1 * | 3/2004 | Murray et al. | 705/14 |

(Continued)

FOREIGN PATENT DOCUMENTS

| | | |
|---|---|---|
| WO | WO2005/089397 | 9/2005 |

*Primary Examiner*—Brent Swarthout
(74) *Attorney, Agent, or Firm*—PatentForge LLC; J. Anderton

(57) ABSTRACT

A vehicle trip logger is disclosed for recording vehicle location and at least one field as a trip category during travel. The trip logger provides data for a report of miles traveled in categories that may be useful for tax, vehicle maintenance or other reporting. For each trip the user selects a menu item displayed on the trip logger as a trip category. The trip logger may provide fields such as account numbers or trip reasons as additional category fields used in reporting vehicle travel. The trip logger may be configured by the user to customize displays and reports shown by the logger. Vehicle location records and trip records with trip fields are saved to internal memory. A trip record is indexed to a group of location records.

4 Claims, 10 Drawing Sheets

U.S. PATENT DOCUMENTS

2005/0288836 A1 12/2005 Glass et al.
2006/0095175 A1* 5/2006 deWaal et al. ..... 701/33
2006/0149467 A1* 7/2006 Nakayama et al. ..... 701/211

* cited by examiner

24

Trip Records Table

26

| Index | Strt Lat/Long | End Lat/Long | Trip Field |
|---|---|---|---|
| 642 | 45.660/122.331 | 45.660/122.335 | Business |
| 643 | 45.660/122.336 | 45.662/122.340 | Charity |
| 644 | 45.661/122.333 | 45.672/122.334 | |
| 645 | 45.662/122.334 | 45.672/122.340 | |
| 646 | 45.663/122.335 | 45.672/122.341 | |
| 647 | 45.665/122.335 | 45.672/122.345 | |

50 22 20

Locations Record Table

| Index | Time | Lat/Long. |
|---|---|---|
| 642 | 12:46.5 | 45.660/122.331 |
| 642 | 12:47.0 | 45.660/122.332 |
| 642 | 12:47.5 | 45.660/122.333 |
| 642 | 12:48.0 | 45.660/122.334 |
| 642 | 12:48.5 | 45.660/122.335 |
| 643 | 14:46.5 | 45.660/122.336 |
| 643 | 14:47.9 | 45.660/122.337 |
| 643 | 14:47.5 | 45.661/122.338 |
| 643 | 14:48.0 | 45.661/122.339 |
| 643 | 14:48.5 | 45.662/122.340 |

50 18a 18b 18c 18d 18e

Fig. 3

24A

Trip Records Table

26

| Index | Start Lat/Long | End Lat/Long | Trip Field |
|---|---|---|---|
| 642 | 1006 | 1010 | 1 |
| 643 | 1011 | 1407 | 2 |
| 644 | 1408 | 1502 | 1 |
| 645 | 1503 | 155 | |
| 646 | 1556 | 161 | |
| 647 | 1615 | 174 | |

22A

52A

56A

20

Locations Record Table

52

| Index | Ref | Time | Lat/Long. |
|---|---|---|---|
| 642 | 1006 | 12:46.5 | 45.660/122.331 |
| 642 | 1007 | 12:47.0 | 45.660/122.332 |
| 642 | 1008 | 12:47.5 | 45.660/122.333 |
| 642 | 1009 | 12:48.0 | 45.660/122.334 |
| 642 | 1010 | 12:48.5 | 45.660/122.335 |
| 643 | 1403 | 14:46.5 | 45.660/122.336 |
| 643 | 1404 | 14:47.9 | 45.660/122.337 |
| 643 | 1405 | 14:47.5 | 45.661/122.338 |
| 643 | 1406 | 14:48.0 | 45.661/122.339 |
| 643 | 1407 | 14:48.5 | 45.662/122.340 |

18a 18b 18c 18d 18e

54

Trip Field Table

56

| Category | Ref |
|---|---|
| Business | 1 |
| Charity | 2 |
| Personal | 3 |

Fig. 3A

VEHICLE TRIP LOGGER

BACKGROUND

The present disclosure relates to vehicle trip loggers and more specifically to vehicle trip loggers that record a trip category selected by the user on the logger, together with a series of vehicle locations determined by a vehicle positioning system. Examples of vehicle location trip loggers that record trip categories are found in the following patents and patent application publications: U.S. Pat. No. 5,550,738; U.S. Pat. No. 5,557,524; U.S. Pat. No. 6,393,346; U.S. Pat. No. 6,741,933; U.S. Pat. No. 6,975,929 and US2003/0110092. The disclosures of these references are incorporated herein by reference in their entirety for all purposes.

SUMMARY

A vehicle trip logger is provided that includes a positioning system, memory, a microprocessor and a user input that creates a trip record for reporting purposes. During a trip, the vehicle trip logger determines vehicle location and typically creates a series of location records as latitude and longitude references in memory together with timestamps. In addition to the location record, the trip logger creates a trip record which includes field entries to categorize the trip, a trip start position and a trip end position. The trip logger accepts user input to select displayed menu items for the field entries saved in the trip record.

The trip logger is configured to periodically transfer the data records to a computer with tools to create a more comprehensive report for tax records, employer reimbursement, accounting purposes, or other analysis. The report may sum all of the accrued mileage in categories defined by the user selected fields. The mileage in each category may qualify as a tax deduction at different rates set by tax code. The deduction rates may be programmed into the trip logger. The trip logger may transfer data to another computer using a wireless connection, removable memory, a cable or another method.

Trip logger memory stores commands and procedures executed by the microprocessor. Some functions are executed in the background without user interactions. Some functions present data and menus on a display and may require the user to enter data or select items from the display that are saved in memory. Selected items or data may configure the logger to perform different functions.

The trip logger includes a display screen and user inputs such as buttons. The trip logger is programmed to display user menus. User menus presented may include trip logger configuration information and menu items associated with fields. For example, trip field categories or menu items may include "business", "charity" and "personal" and are used in the mileage and travel report.

The end of a trip and the start of a new trip are typically defined by the vehicle not moving for a set period of time. The trip logger microprocessor checks for a series of sequential location records with no location change. If the vehicle does not move for a set period, for example five minutes, the trip logger assumes that all of the location records between the last position change, and the previous vehicle stop of at least five minutes, comprise a single trip.

Records may also include a unique trip index number. The logger may include position parameters in the location record such as heading, speed and distance between location records as well as altitude and a time stamp.

If the user does not enter a menu item into a required field such as a trip field at the beginning of a trip, the trip logger prompts the user with audible sounds and/or screen reminders to select a trip field from the menu. The selected trip field or other field entry may be included in the trip record.

Associated software may provide report generation capability using data from the data logger. Report structures may be available in the associated software that prepares reports of more general interest. The user may be able to generate custom reports to meet individual needs. Examples of reports generated by associated software include IRS conforming mileage, fuel expense, maintenance expense, mileage by account, reason or trip category or employee reimbursement. Reports may use data from one trip logger or reports may aggregate data from a plurality of loggers.

The advantages of the present invention will be understood more readily after a consideration of the Drawings and the Detailed Description.

BRIEF DESCRIPTION OF THE DRAWINGS

FIG. 3 is an example of the data recorded by the trip logger as a location record which in this example includes latitude and longitude, a trip index and time stamp and as a trip record which in this example includes a trip index, trip start latitude and longitude and trip stop latitude and longitude and a trip field.

FIG. 3A is an example of the data recorded by the trip logger similar to FIG. 3 but using references to other tables as entries in the trip record table.

DEFINITIONS

"Positioning system" for the purpose of this disclosure encompasses any system which provides a coordinate or a reference location such as latitude and longitude, or a reference to one or more fixed points such as cell phone towers or fixed transmitters. Positioning systems may include LORAN, Differential GPS, Wide Area Augmentation System (WAAS), GLONASS, Beidou or Galileo. The positioning system may be a combination of technologies such as a GPS system with an accelerometer to provide position coordinates where GPS system coverage is not complete. A GPS system may be combined with a LORAN system to improve accuracy or performance.

"Positioning parameters" are defined for the purposes of this disclosure as data provided by the positioning system or derived from data provided by the positioning system. This may include latitude, longitude, altitude, heading, velocity, acceleration, momentum and distance traveled.

"Fields" are defined for the purposes of this disclosure as a variable relating to a trip saved to memory. Field entries my categorize trips and mileage for reporting. Typical fields, used only as examples for this disclosure, include "Trip," "Account" and "Reason."

"Menu Items" are defined for the purposes of this disclosure as lists of optional entries presented to a user for selection as field entries. The menu items may be presented on the display and the user may select a menu item to populate the field. For the trip field, the logger may display menu items "Business", "Charity" and "Personal" for user selection.

"Field Entries" and "Field Selections" are defined for the purposes of this disclosure as menu items selected from the menu items to populate fields for the duration of a trip or a plurality of trips. For example, a field entry for the trip field may be one of "Business", "Charity" or "Personal."

These fields and menu items are presented as examples and not as limitations. Fields and selectable menu items may be preprogrammed into the trip logger or fields and selectable menu items may be defined by the user. The user may define additional fields and menu items than those used here as examples.

DETAILED DESCRIPTION

Figure 1:
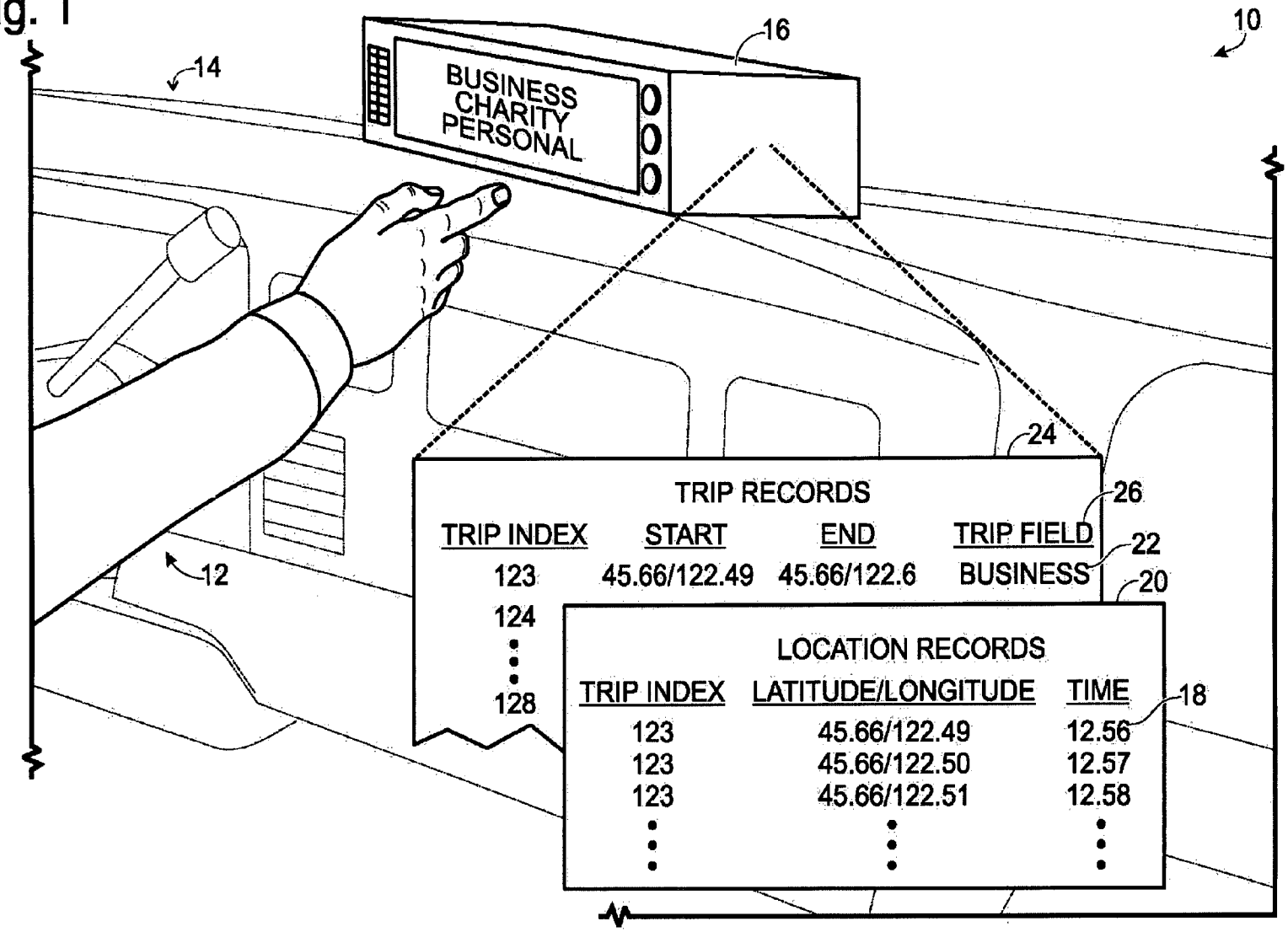
FIG. 1 is a perspective view showing a user selecting a trip field on a trip logger, the trip logger including location records and trip records saved in internal memory of the trip logger.

FIG. 1 is a trip logging application 10 showing a user 12 beginning a trip in vehicle 14 that may be a personal trip, a business trip, a trip for charity or another kind of trip. User 12 is shown selecting an item as a field entry from a menu displayed by a vehicle trip logger 16. FIG. 1 also shows location records 18 in location record table 20 and trip records 22 in trip record table 24, all of which are stored in logger 16.

Vehicle trip logger 16 determines vehicle position at regular intervals during a trip and saves the position data as location record 18 in location records table 20. Trip logger 16 also creates trip record 22 in trip record table 24. Trip record 22 may include a start point, an end point, both of which are also stored in two location records 18, and one or more field entries 26 for categorizing the trip.

Vehicle 14 may be a two wheeled vehicle such as a bicycle or a Segway human transporter. Vehicle 14 may include bipedal locomotion such as walking or running.

Figure 2:
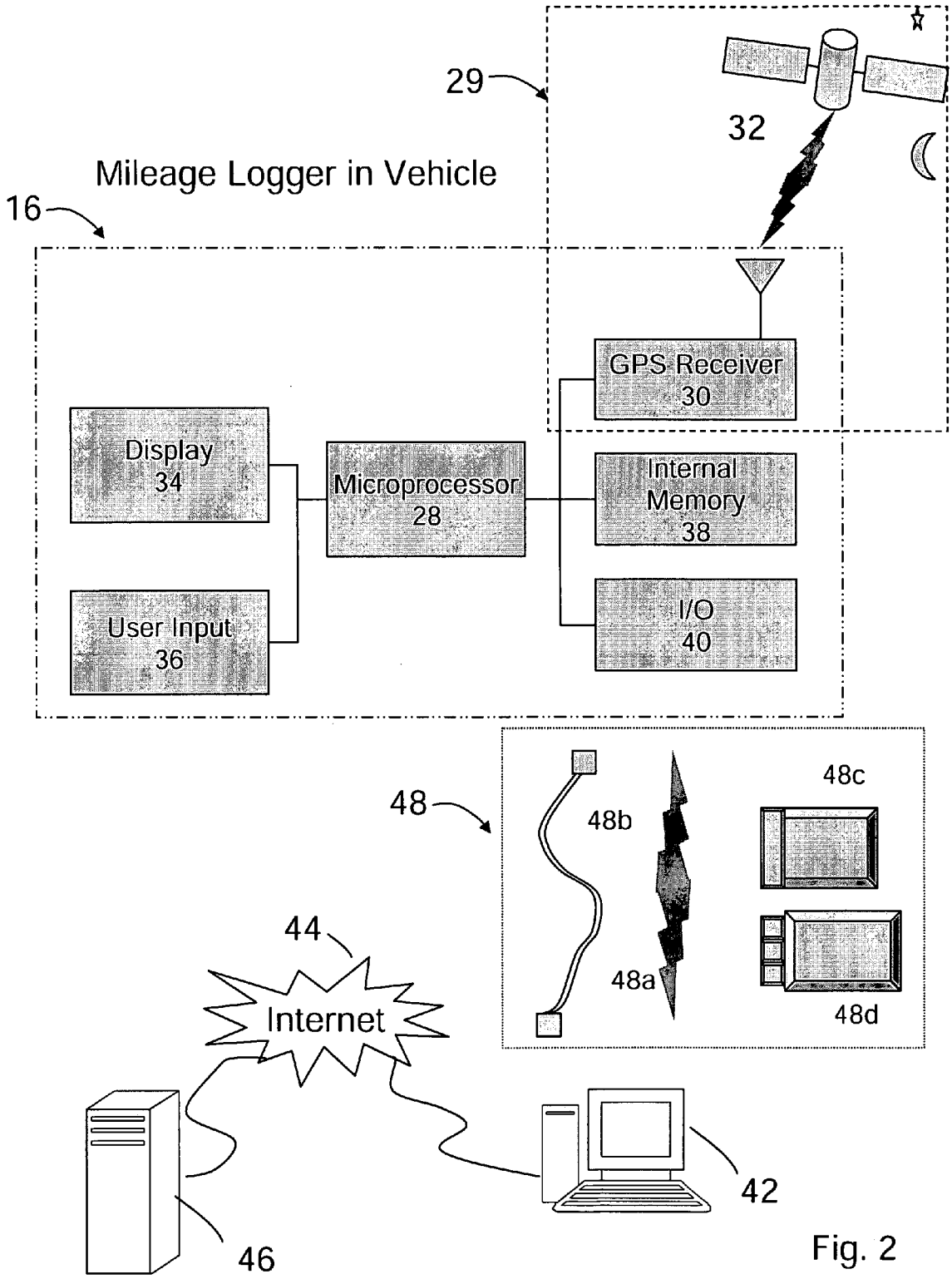
FIG. 2 is block diagram of the trip logger including a processor, a positioning system, a display, user inputs, memory and I/O functionality.

FIG. 2 is a block diagram showing a vehicle trip logger 16 including a microprocessor 28, a positioning system 29 shown as a GPS receiver 30 to communicate with a GPS satellite 32, a display 34, a user input 36, internal memory 38 and I/O 40 for connecting with a processor based peripheral 42 shown here as a base computer connected to internet 44 and a server 46. Server 46 may include additional vehicle trip logger reporting functionality. Logger 16 may connect directly to server 46 over internet 44.

Memory 38 stores commands and functions that are accessed and executed by microprocessor 28. Commands may control the operation of logger 16 in collecting and recording trip data in memory 38, displaying data and menu items on display 34 and accepting input from user 12. Microprocessor 28 may determine the beginning and end of trips from location records 18 in location record table 20. Microprocessor 28 may filter location data and remove or adjust erroneous data. Microprocessor 28 may set the interval or frequency of location data collection and/or recording.

I/O 40 may include wireless communication. Wireless communication 48*a* compatible with I/O 40 may include a cell phone network, an IEEE 802.11 wireless local area network (WLAN) access point, an RFID compatible radio frequency signal, or an IEEE 802.15.1 and/or a wireless personal area network (PAN) connection such as a Bluetooth. Trip logger I/O 40 may be a socket for receiving a cable 48*b*, removable memory such as a CF card 48*c* or a USB thumbdrive 48*d* as depicted at 48 or similar transportable memory. Trip logger 16 may connect through I/O 40 to a laptop, a personal data assistant (PDA), a cell phone, a navigation system, a server, a computer, a WLAN access point or other processor based system. Logger 16 may send and/or receive commands and/or data through I/O 40. I/O 40 may include a speaker.

Trip logger display 34 may be any display screen such as an OLED, LED or LCD screen that can display text and/or graphics. Trip logger 16 may use audible prompts either as tones or spoken commands instead of or in addition to using display 34. User input 36 may include buttons or voice recognition capability and a microphone. User input 36 may include a set of selection buttons and a separate set of function buttons that control which menus are displayed. User input 36 and display 34 may be combined in a touch screen display. User input 36 may include a camera or imaging system.

FIG. 3 shows an example of a set of location records 18 and an example of trip record 22 recorded by trip logger 16. Location record 18 in location table 20 and trip record 22 in trip record table 24 may both include a trip index 50 that connects or indexes a set of location records to a trip record. Records may include a timestamp, latitude and longitude and a mileage value determined from the previous sequential location record and the current location record. Trip record 22 may also include a field to categorize the trip identified here as a trip field 26 for example only.

In FIG. 3, index 50 of trip record 22 has a value of "642" in trip record table 24. Record 22 also has start and end location entries and a trip field entry of "Business." Location record table 20 shows location records 18*a* through 18*e* each with index 50 value of "642" identical to index 50 of trip record 22. These five location records are individual locations along a path determined by positioning system 29 during the trip and recorded in memory 38. Additional tables and additional fields may be used in data logger 16 to store other information.

Location record 18*a* may correspond to the start location of trip record 22. The fifth location record 18*e* may correspond to the end location of trip record 22.

Microprocessor 28 may determine which location records correspond to a trip record by referencing index values 50. Trip record 22 in table 24 may have additional references than index 50. Trip record 22 may have a reference that combines the date with the number of the trip or trip record. For example, logger 16 may have recorded 6 trips on the third of June in 2005. The date may be formatted as ddmmyyyy, or 03062005. The format of the reference for the next trip may be 03062005-07. "-07" refers to the seventh trip of the day. This reference may be a more intuitive reference to use in sorting through multiple trip references to find one reference.

While FIG. 3 shows tables with data as text and coordinate entries for ease of explanation and description, the entries in the trip table may be references to entries in other tables. FIG. 3A shows tables and records similar to FIG. 3 but using entries of references to other tables. Similar numbering is used for items in FIG. 3A corresponding to items in FIG. 3.

Location records may include a location record reference 52 that is unique for each location record 18. Values shown for location reference 52 are 1006 for 18*a;* 1007 for 18*b;* 1008 for 18*c;* 1009 for 18*d*, and 1010 for 18*e*. For trip record 22A, corresponding to record 22 in FIG. 3, the entry or reference 52A for the field of Start Lat/Long is 1006 and the entry or reference 54A for End Lat/Long is 1010. These correspond to Lat/Long entries in table 20A as 45.660/122,331 and 45.660/122,335 as shown in record 22.

Menu items and/or entries for trip field 26 may be in a separate trip field table 54. Trip field table 54 shows three entries "Business," "Charity," and "Personal" with a trip field reference number 56 of 1, 2, and 3 respectively. The entry or field reference 56A for record 22A in table 24A is "1," referring to the first entry of the trip field table, "Business."

The data structure described improves data usage and data access. Less memory capacity is required in this schema than other structures. More memory capacity improvements are realized when optimization methods described later are used. Reporting is also optimized by the use of trip records holding most relevant data. Location records can be accessed easily and additional reporting capabilities utilized to map the paths recorded by logger 16.

Trip logger 16 may have capability to identify the vehicle it is in. Vehicle 14 may include a radio frequency ID (RFID) tag and logger 16 may be able to read the RFID tag when proximate to the chip. The RFID tag may provide a unique vehicle identifier that is incorporated into records by logger 16 in memory. A removable memory may instead be used for identification. Removable memory or an RFID tag may be used to identify the user to data logger 16. The user identity may be included into records of logger 16.

Trip logger 16 may be permanently wired into vehicle 14. Logger 16 may receive power from an outlet in vehicle 14 and may be unplugged and removed from vehicle 14. Logger 16 may be configured to save critical data to memory on power loss. Logger 16 may be an integral part of the dash instead of a separate unit on the dash. Logger 16 may be combined with other functional units in the dash such as a radio or a cell phone.

Figure 4:
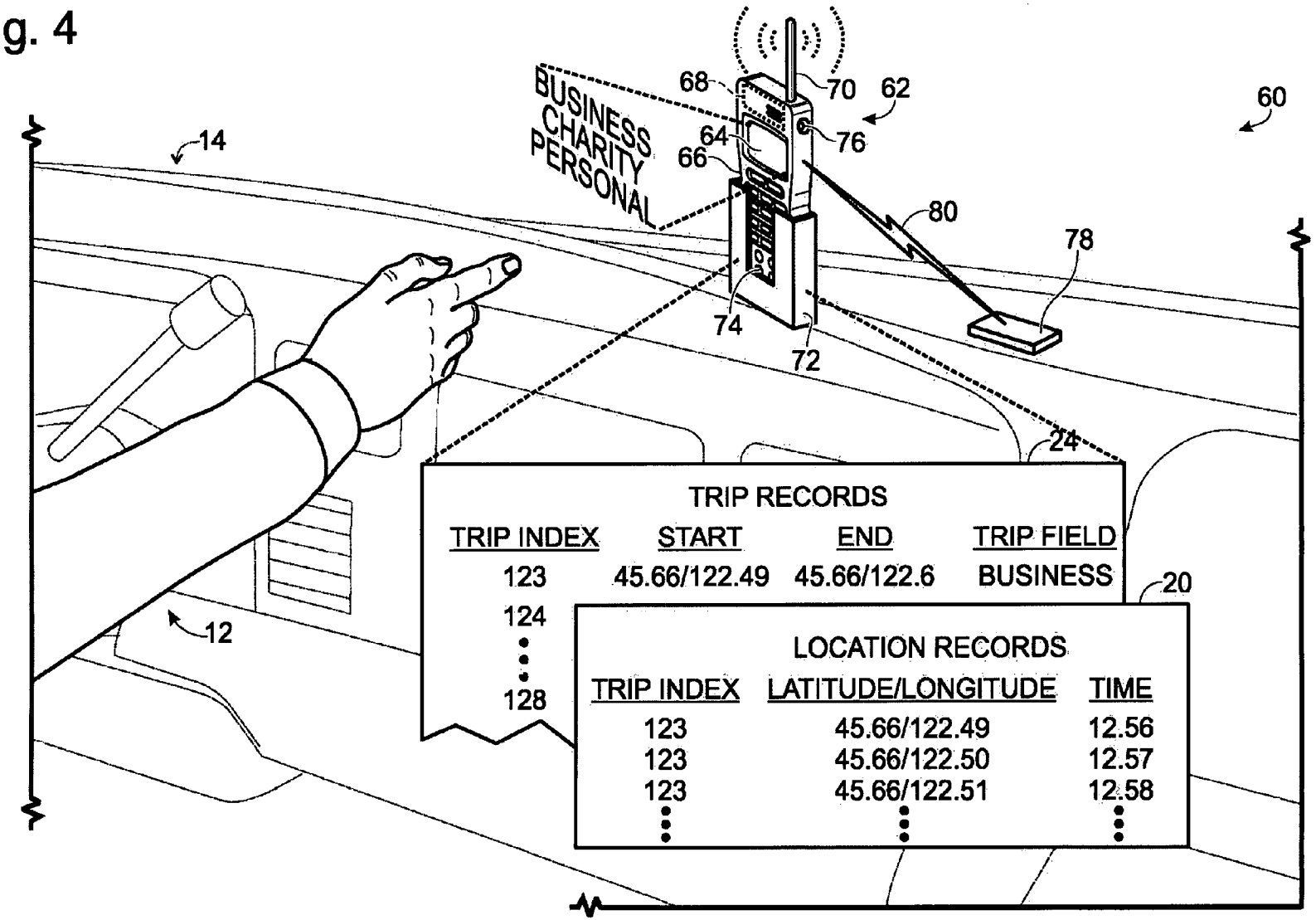
FIG. 4 is a perspective view of a data logger integrated with cell phone functionality operating in a car to record a trip and trip categories including an RFID chip to identify the vehicle to the data logger.

Trip logger 16 may be implemented as an application 60 in a cell phone or PDA 62 enabled with GPS or other positioning system capability as shown in FIG. 4. The cell phone 62 may include a screen or display 64, input keys 66, positioning system capability embodied here as receiver 68 and antenna 70, mount 72, microphone 74 and speaker 76. Data and menu selections previously described as being shown on display 34 may be shown on cell phone display 64. Input keys 66 of cell phone or PDA 62 may be used to select menu items as field entries. Keys 66 may additionally be used to enter data such as menu items or account names into the data logger functionality of phone or PDA 62. A data structure with tables 20 and 24 as depicted in FIGS. 1 and 3 may be similarly implemented in cell phone data logger 60. Cell phone logger 60 may be a data logger 16 that includes cell phone capability.

Cell phone data logger 60 functionality may be uploaded as a software application to PDA or cell phone 62 and no other hardware may be associated with the data logger software.

The data logger application 60 implemented on a cell phone or PDA may be associated with hardware used to associate the data logger application to specific vehicles. For example, vehicle 14 may have an identification unit 78 with wireless capability such as infrared or Bluetooth. Cell phone or PDA 62 may have compatible wireless capability and cell phone or PDA 62 when in proximity to vehicle 14 may establish a communication link 80 with wireless identification unit 78 of vehicle 14. Once a communication link is established, phone or PDA 62 may determine or receive a vehicle identifier. While functioning as a data logger, cell phone or PDA 62 may include the vehicle identifier or a user personal identification in tables 20 and/or 24.

ID unit 78 may be a radio frequency ID (RFID) tag and logger 60 may have capability to interrogate the RFID and receive data emitted by unit 78. ID unit 78 may be a USB type thumbdrive holding identification information. Unit 78 may plug into I/O 40 and provide ID information to logger 16. The ID information may be a personal identification unique to the user or the information may be vehicle identification.

Positioning system 29 and/or 68 may be an accelerometer that determines acceleration of vehicle 14. Using a fixed reference point, acceleration data can provide position data for vehicle 14. A solid state accelerometer typically measures the deflection of a beam etched or cut into a substrate associated with an integrated circuit. By defining a starting point and measuring the acceleration in two or three coordinate directions, the location of a vehicle can continuously be determined along a trip route to provide latitude and longitude references similar to the references determined by a GPS receiver.

Other positioning systems used may include Differential GPS, such as that used on railroads and maritime applications for increased position accuracy. Alternately, triangulation from cell phone antennas could be used to determine and report vehicle location. Other positioning systems may be used and still fall within the scope of this disclosure.

Operation

Vehicle trip logger 16 is installed in a vehicle 14, which may be used for personal trips, business trips, charity trips or other trip purposes. Vehicle 14 is typically a passenger automobile, but logger 16 can be installed in a truck, bus, airplane or any other vehicle. Positioning system 29 determines vehicle location at regular time intervals. Microprocessor 28 records the vehicle position as location record 18 in memory 38. The time intervals for recording data may be optimized to provide an accurate resolution of the trip route and trip distance without occupying large amounts of memory to record the data. The location determination interval or recording time interval may be automatically adjusted as a function of speed, frequency of turns, signal strength, etc.

For the purpose of example only, three fields are defined here, a trip field 26, a reason field and an account field. Each field may have associated menu items to be used as field selections. Some fields may be required fields and other fields may not be required. Fields, menu items and required fields are all user definable and configurable. Logger 16 may have default values preprogrammed into the unit.

If a trip has started and a required field has not been selected, vehicle trip logger 16 may prompt the user for field information. Logger 16 may prompt for non-required fields as well. Trip logger 16 may beep, generate a voice announcement or display 34 may flash to prompt the user.

Trip logger 16 may record a trip field for each trip. The trip field is selected from a menu by the user and entered into trip logger 16 typically at the beginning of each trip. Trip logger 16 has a set of menu selection options preprogrammed into the unit. Menu items may include categories such as charity, business, commuting, medical and moving. In addition to predefined menu items for trip field 26, the user may define additional items. Some menu items may be defined in taxation references and include uses where trip mileage would be tax deductible. Tax deduction rates may additionally be programmed into trip logger 16. Menu items with tax references may be included for other fields as well. These selected menu items may be used to report vehicle mileage by categories.

At the start of a trip, user 12 may display the menu for the trip field. User 12 may select a menu item by pressing a user input button next to the appropriate menu item presented on display 34. This selects a menu item, for example "Business," and trip logger 16 may include a reference to "Business" in location record 18, trip record 22, or both, in internal memory 38. Menu items for other fields are selected similarly with menu items presented on the screen and selected by using a button corresponding to the menu item. The button of user input 36 may be integrated in a touch screen of display 34 and user 12 may touch the screen proximate to the menu selection to choose that item.

The start and end of a trip may be determined by vehicle 14 stopping for a set period of time. Microprocessor 28 may compare the most recent location records 18. When a sequential set of location records are recorded with no substantial change in position, microprocessor 28 determines the trip has ended. Microprocessor 28 may delete sequential location records 18 in memory 38 when it determines they report the same location. The end of the trip may instead be defined by the user indicating a trip change by pressing a button or a touch screen.

Trip record 22 may include a starting point, an end point, a trip distance and an index to connect the trip record to a set of location records 18. Logger 16 may additionally include menu selections for fields in trip record 22.

Trip logger 16 may determine the distance between sequential recorded location points. Logger 16 may also determine a heading from sequential location records. The mileage for the trip may be the sum of the distances between sequential points that were recorded during the trip.

Trip record 22 may be initiated at the start of a trip. The starting point may be the first recorded location record. The end point may be the last recorded location record. The trip record end point may be updated with a location value from each new location record 18 during the trip.

Alternately, trip record 22 may be initiated when microprocessor 28 determines the trip has been completed. The start point and end point for the trip are determined and recorded at that time. Trip record 22 in this case is created once and then not updated with a new end point in memory 38.

Time intervals for collecting and/or recording location data may be set as a function of required mileage accuracy. An accuracy value for mileage may be 98%. An initial recording time interval is determined that can meet that requirement. The optimal recording time interval may change depending on the speed of the vehicle or other factors. Memory capacity for trip logger 16 can be optimally sized to hold all the records that will be generated over a set period at that frequency or a range of frequency of data collection. Recording frequency may be on the order of once per second.

Alternately, positioning system 29 may determine vehicle location at a set time rate or frequency and trip logger 16 may determine a variable frequency to create location records 18 in memory 38. For example, positioning system 29 may report vehicle location once per second and report that data to microprocessor 28. Microprocessor 28 may determine that creating location record 18 from receiver 30 data every 10 seconds will provide an accurate measure of mileage, while using a minimum of space in memory 38. The rate of location reporting by GPS receiver 30 may vary with signal strength.

Figure 5:
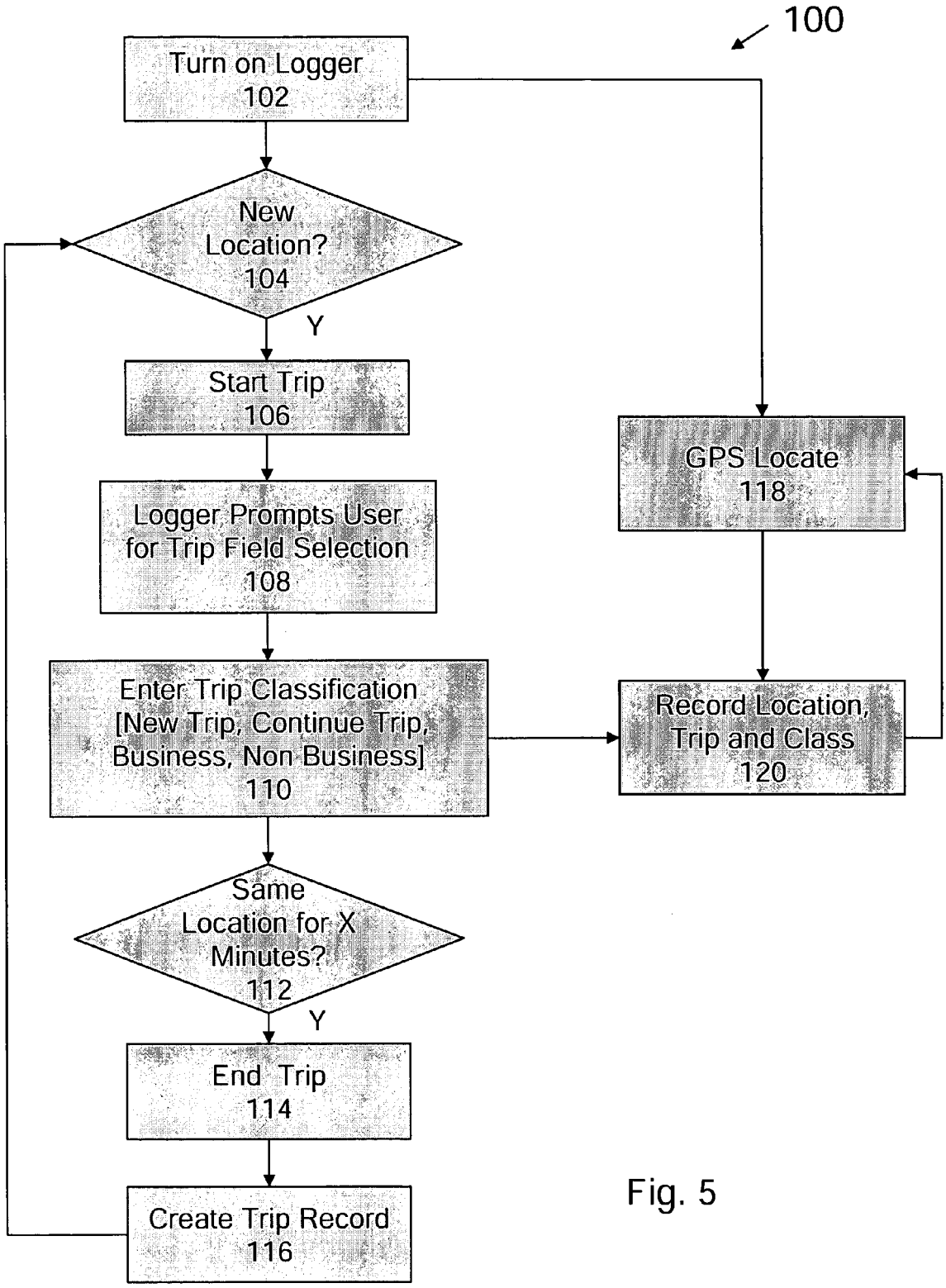
FIG. 5 is a flow chart showing a sequence of functions and decisions executed in the trip logger while recording location information.

FIG. 5 is a flow chart 100 of steps in the operation of trip logger 16. In step 102 the unit is turned on. The unit may have an on/off switch. Alternately or additionally, the unit may be connected to the vehicle electrical system and may be on a circuit that is only powered with the key turned on, so that logger 16 turns on automatically when the car starts.

In step 104 of flow chart 100, logger 16 determines from location records 18 whether vehicle 14 is moving. Once logger 16 determines the vehicle is moving, the trip starts at 106. The user may have previously defined one or more required fields. If trip field 26 has been defined by the user as a required field and trip field 26 has not been specified, trip logger 16 prompts user 12 to select trip field entry at 108. If additional required fields have been defined, trip logger 16 will prompt the user to select items to fill all the required fields. Trip logging continues whether or not a field value is selected. Trip logger 16 typically displays a menu of possible trip field options with the prompt. User 12 may select a trip field entry by pressing a button on user input 36 at step 110.

At step 112, trip logger 16 monitors location records. When location records 18 have identical location references over a predetermined time period, microprocessor 28 determines the trip is complete at 114. At 116, trip record 22 is created and returns to step 104 for the start of a new trip.

Alternatively, trip record 22 is initiated at the trip start. Then, at 116 trip record 22 is updated with current position values from the last recorded location record 18.

Running in parallel with the above steps 102 to 116, positioning system 29 determines the vehicle location at step 118 and a location record 18 is created including vehicle location data of step 118. These two steps continuously execute in a loop.

Logger 16 may perform a self test at start up (not shown in flow chart 100). The self test may check to determine if an antenna is connected and functioning correctly. The self test may check connections between components including the connections between the microprocessor and memory components, I/O components, display controllers, and positioning systems. The self test may initiate self tests on other components and check the results of the tests.

Other tests may determine the amount of memory occupied by programs and records and the amount of memory free. Other tests may check for the elapsed time since download and synchronization with computer 42 and server 46. Logger 16 may prompt the user in response to the self test to synchronize the unit with server 46 and/or computer 42. Synchronization may include, clearing memory by downloading records and upgrading software.

Figure 6:
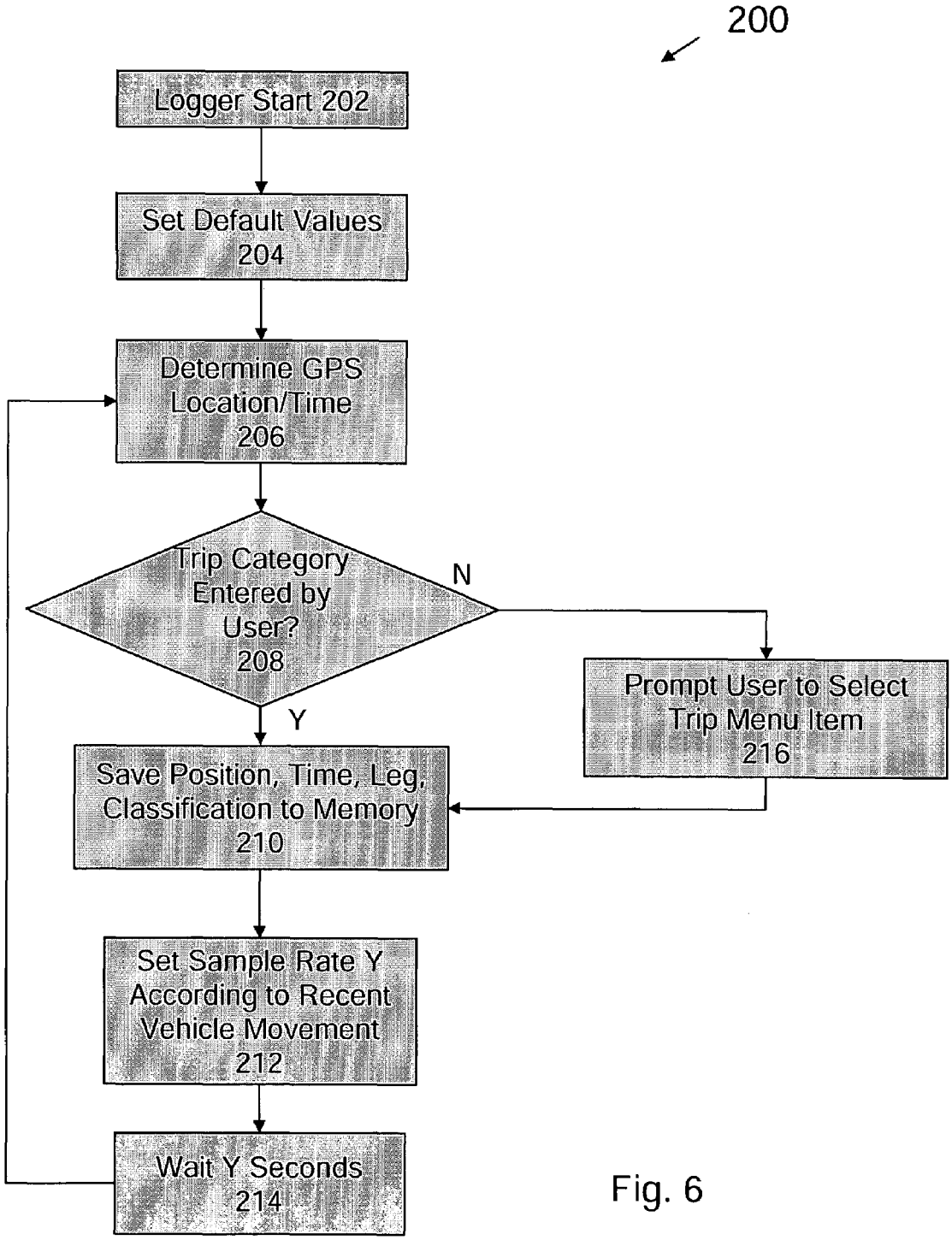
FIG. 6 is a flow chart showing a sequence of functions and decisions executed by the trip logger while determining and recording vehicle position with a trip field.

FIG. 6 is a flow chart 200 showing functions and steps associated with positioning system 29 included in trip logger 16. The unit starts at 202 with the unit being turned on or the unit starting a new trip. Default values are set at 204. Default values may include the sampling rate or frequency of collecting location data by positioning system 29, recording rate of location data and/or field values. At 206, positioning system 29 determines a location for the vehicle and a timestamp. At 208, a determination is made of whether required fields have been entered by user 12. The user may be prompted to fill all the fields which have been defined as required fields. Logger 16 operation will continue whether or not items are selected as field values.

If the classification has been entered, location, time, field values and any other appropriate data are entered into records in memory 28 at 210. At 212, logger 16 may adjust the data collection frequency of the positioning system 29 according to recent vehicle movement. Logger 16 may then wait the predetermined time interval at 214 and then return to step 206 to again determine location and time again. If the trip field is not set by the user at 208, logger 16 may perform an additional step of prompting the user to enter a trip field at step 216.

Alternately, at step 212 the rate of determining location by receiver 30 may be constant or may be set by the receiver or positioning system. The rate at which location records 18 are created may instead be adjusted according to the rate of vehicle movement or other factors. In this case, step 214 will determine according to current data acquisition criteria whether a record should be created with the current location data. Flow then returns to step 206.

Alternately, logger 16 may record location records 18 at a set frequency that does not change.

These steps and functions performed by trip logger 16 are presented as examples of possible operations and not as limitations. A logger may have additional steps, fewer steps, different steps or steps in a different order and still be within the scope of this disclosure.

Location record 18 may be a record of a first type. Trip record 22 may be a record of a second type.

In addition to trip field references, menu items may include account references in terms of names or numbers. Trips to specific sites for business may be associated with an account. Mileage may be reported by trip field entries and/or by account field entries.

Account information may be associated with coordinates or a location. Logger 16 may automatically associate location records 18 or trip records 22 with the account number location. For example, user 12 may frequently visit a business with an account reference and a location. When trip logger 16 determines it is within a certain distance of the business location, it may automatically register that account number with the trip and enter the account value in the account field. Alternately, the account may be defined by an area with boundaries.

User 12 may want additional details of the trip included in a report. A reason field could include details defined by user 12. For example, a sports trainer could include details of the sport the lesson covered, such as hitting practice, pitching practice or batting practice. Mileage may be reported by the reason field or all of the three example fields.

Logger 16 may be configured to associate a location reference or coordinate to significant landmarks and to record information in memory 38 in response to vehicle 14 approaching the landmark. Logger 16 may store information associated with landmarks. Logger 16 may download information to memory 38, such as pricing for hotels in the area, hotel quality, restaurants and menus, churches, gyms or other information. The data may be downloaded from server 46. The information may be accessed by requesting information on services as a function of the current location of the vehicle. Alternately, the information may be accessed as a function of a remote location. Logger 16 may automatically present stored landmark data on approaching the landmark.

Logger 16 may be programmed with a profile of the user. Logger 16 may automatically associate landmarks of interest with the user by accessing the profile. For example, the user profile may indicate an interest in Civil War battlefield sites. Logger 16 may automatically display information associated with battlefield sites as vehicle 14 comes into proximity to such a landmark. Logger 16 may display information about landmarks along a route rather than by location.

Logger 16 may store a set of coordinates which are the location of major road crossing boundaries, such as state lines. As vehicle 14 approaches within a certain distance of the boundary, logger 16 may save a reference to the boundary information to memory as part of location and/or trip records.

Coordinates may be stored in memory and referenced to a landmark, an account or some other significant point. Coordinates reported by positioning system 29 are limited in their accuracy and precision. Also vehicle 14 may not arrive at the exact coordinates of a landmark such as an account location. Vehicle 14 may park at the outset edge of a parking lot for the account. To compensate for small inaccuracies in the reported coordinates, inaccuracies of coordinates stored in memory, and the final position of vehicle 14, logger 16 may register a correlation between two coordinates if they are within a set distance of each other rather than exactly equal values. This correlation distance may vary depending on the kind of correlation being made.

Logger 16 on approach to a fixed coordinate or reference point in memory may be preprogrammed to make a correlation between the fixed coordinate and the vehicle coordinate at a range determined by the type of response of logger 16. The correlation distance on approaching a first type of reference point such as a landmark of general interest may be much larger than the distance of correlation in approaching a second type of reference point such as an address unfamiliar to the user or the correlation distance to the coordinate of an account that occurs automatically.

For example, the correlation distance to a civil war battlefield, a landmark of general interest, may be 5 miles and the correlation distance to the home of the user may be 100 yards. As vehicle 14 passes within the 5 mile radius of the civil war battlefield, an audio file with a voice announcement may play describing the battlefield. As vehicle 14 passes within the 100 yard radius of the coordinates referenced in memory as home, a different kind of reference point, the theme to Mr. Roger's neighborhood may play.

User 12 may be able to define an area that corresponds to a landmark. An account may be a campus of several buildings and rather than a coordinate the account location may be defined as an irregular area with boundaries. Logger 16 may correlate the vehicle location with the account on crossing the boundary into the campus.

Trip logger 16 may be configured to make a wireless connection while in use and transfer data. Logger 16 may have cell phone capability or may automatically connect to a wireless network when one is detected. Logger 16 may receive or send data over the wireless connection. Logger 16 may be programmed to upload data under certain conditions. For example, logger 16 may upload landmark information when it passes a boundary to a new locale with different landmark information than was previously contained in logger 16. Vehicle 14 may be restricted to use within a set boundary. Passing the boundary may cause logger 16 to make a communication connection and send information as to a use violation and the current position of vehicle 14.

Trip logger 16 may be configured to record and report other information. It may determine and report maximum and average speed for a trip or time period. Trip logger 16 may accept input as to car maintenance such as fuel purchased or consumed and maintenance dates.

User 12 may be able to configure trip logger 16 using a personal computer through I/O 40 functionality. Logger 16 may interface more directly to server 46. Processor based peripheral 42 may have additional software applications that configure trip logger 16. Processor based peripheral 42 may be used to configure additional menu selections. For example, user 12 may set up a list of trip reasons or account numbers on peripheral 42. User 12 may be able to upload and integrate the configured lists for menu items in trip logger 16. Trip logger 16 may then continue to function separately from peripheral 42 with the programmed trip reason and account numbers available as menu selections.

Alternately, trip logger 16 may have capability to enter text information through user inputs on trip logger 16. Trip logger 16 may have a keyboard that plugs into trip logger 16 at I/O 40 for entering data directly to the unit.

Records saved in trip logger internal memory 38 may be downloaded to peripheral 42 through I/O 40 and wireless connections, removable memory or other means previously discussed. Peripheral 42 may be connected to the internet and may be further connected to server 46. Server 46 may include additional reporting capability for records downloaded from trip logger 16. Server 46 may download reporting software to peripheral 42 and/or record data may be transferred from peripheral 42 to server 46.

Server 46 may aggregate information from a plurality of data loggers 16. For example, a first user may take notes on client visits to a certain client Acme Cement on a first logger 16. The notes are saved in logger 16 and associated with the account name in memory. When logger 16 is synced to server 46, it may download all the account information and notes to the server. A second user with a second logger may also visit Acme Cement. The notes from the first logger may be uploaded to the second logger 16 so the second user may access the first user's notes on their next visit.

Additional reporting capability may include mapping. Location records from trip logger 16 may be overlaid onto a graphic representation or map including roads and landmarks to provide a visual display of trips associated with records. Reporting capabilities may include route optimization. Route optimization may suggest more efficient paths for future trips.

In one embodiment, data logger 16 connects to peripheral 42 and synchronizes with server 46 through a trip log web site. User 12 may access the web site and configure logger 16 at the web site. Server 46 may connect to logger 16 and download the serial number or other unique identifier from the trip logger. Server 46 may have previously connected to trip logger 16 and may have saved parameters such as the serial number, the software rev, memory type, etc. Server 46 may perform required maintenance and install upgrades to logger 16 based on the recorded parameters such as upgrading software to a new rev. Trip records and/or location records may be downloaded to the server from logger 16 when connected to peripheral 42. Portions of memory 38 may be cleared to make room for additional trip records, location records and/or other data.

User 12 may download audio files from server 46 or processor based peripheral 42. User 12 may want to customize logger 16 so interactions are more esthetically pleasing. User 12 may configure logger 16 so prompts are indicated by music. For example, a prompt by logger 16 to enter a trip field for the current trip may be configured to play a downloaded audio file of a Mozart Concerto. User 12 may add prompts that are not default functions. User 12 may configure logger 16 to play an Iron Butterfly song whenever vehicle 14 approaches the user's home.

Trip logger 16 may include a filter to identify incorrect location data. GPS receivers depend on a direct signal between satellites and the GPS antenna to determine location. In some locations, the signal may 'bounce' off an obstruction such as a building or a hillside. The location reported by GPS receiver 30 may reflect the added distance the signal traveled and the reported location may be miles away from the last reported position. The next reported position may not bounce off the obstruction and will again be proximate to earlier location records.

It is advantageous in this and other cases to filter the data of vehicle location records that do not reflect a reasonable speed or direction of the vehicle when compared to previous location points. As previously discussed, positioning system 29 or microprocessor 28 may determine positioning parameters such as heading, speed, altitude, acceleration and/or a distance for each location record. A heading may comprise a compass direction determined as a vector in terms of relation to magnetic or geographic poles.

A location record filter may compare headings of sequential records and remove or disregard records that reflect a change in heading over a certain value. For example, positioning system 29 determines vehicle location at a frequency of once per second. The headings between three location records show the car turned more than 45 degrees per second. Since a turn rate of 45 degrees per second is excessive for normal driving, this record may be assumed to be inaccurate. The inaccurate location record may be deleted. With an adequate recording frequency, if the record is deleted erroneously, the loss of one record will not significantly degrade the accuracy of the measured mileage. Whereas inclusion of an erroneous record can have a large effect on the reported mileage. The filter may be configured to recognize and reconcile a series of erroneous data points.

Alternately, the location record filter may determine speed of the vehicle over sequential location records and reject records with a speed greater than a certain value. For example, if the last 10 location records reflect an average speed of 40 miles per hour and the $11^{th}$ location record reflects a speed of 80 miles per hour, the $11^{th}$ location record may be deleted.

The location record filter may function by reducing or increasing the mathematical weight of points or records that deviate from a smooth path to provide a smoothing effect. The smoothing effect or filtering may incorporate the approximate mass of the vehicle. Other parameters than speed or heading may be used.

Trip logger 16 may optimize memory usage in other ways. Where a series of record logs indicate travel is in an essentially straight line, such as traveling on a freeway, vehicle position data between curves may not add information relevant to miles traveled or speed. For a vehicle traveling five miles in a straight line at 60 miles per hour, the first location point and the last location point for the five miles describe and define the mileage as completely as a thousand data points along the five miles. These points may be termed redundant data or redundant location records. Trip logger 16 may delete the location records with redundant data which do not add relevant information or logger 16 may not record location records at all that do not add relevant information.

These correction and optimization algorithms are presented as examples. Other algorithms may be used and still fall within the scope of this disclosure. Correction and/or optimization algorithms may combine a plurality of methods.

Trip logger 16 may have a preprogrammed default display used while logging a trip. The default display may show the current mileage of the trip, the elapsed time of the trip and the user entered trip field 26. User 12 may customize the display to show other data. User 12 may customize the display to include data such as gas mileage for the trip, current speed, heading, the current time and date, current latitude and longitude and/or the current heading. Other display parameters or values than these may be used. Display of fields and performance parameters may use graphics as well as alphanumerics. Display 34 may show a dial speedometer to display speed. Multiple dials may be displayed to show different parameters on display 34.

Logger 16 may have an option for overriding some default actions by trip logger 16. Trip logger 16 may determine that a trip has ended due to an extended period without vehicle movement. User 12 may have stopped for other reasons and may want to continue the previous logged trip. Logger 16 may prompt the user to determine if user 12 wants to end the previous trip. User 12 may operate user input 36 to select an appropriate menu item indicating that current trip mileage should be included in the trip record of the previous trip.

User 12 may also utilize user input 36 to end the current trip and start a new trip. User 12 may not select a field input for a previous trip and the trip may be saved without the field input. Logger 16 may later prompt user 12 to input missing required and/or optional fields that have not been entered or selected.

User 12 may be able to change countdown time periods. For example, the end of a trip is defined by vehicle 14 not moving for a certain period. A default value may be five minutes. User 12 may be stuck in traffic frequently for extended periods and may change the time period to 15 minutes. User 12 may end the previous trip by selecting an appropriate menu item.

Trip logger 16 may include an option to display the Top Trips. Top trips are the trips with most frequently used field values for the trip field, reason field and account field. Where user 12 makes the same kind of trip frequently, the user may display the top trips showing the frequently used set of values or entries, and select one set of values to automatically load those values for the current trip.

For example, the most frequently used field configuration of a logger may have a configuration of trip record field entries as an account field entry of "Acme Tools", with a trip field entry of "Business", and a reason entry of "Customer Visit." When starting a trip, user 12 may display top trips with user input 36 and then select this first menu item. This will automatically select these field entries and use these field values for the current trip. The combination of which fields should be displayed for top trips may be determined by the user or may be preprogrammed in logger 16.

Trip logger 16 may also be configured to display trip records 22 from trip record table 24. Trip logger 16 may show the field configurations of the last trips in date sequence. User 12 may select one of the trips to use the field values for a current trip. This will set the account, the reason and the trip fields for the current trip to the values used for the trip selected from recent trips.

User 12 may select one or several sets of field values or field value configurations and identify them as preferred configurations or favorite trips. User 12 may be able to call up a menu of favorite trips and select a menu item as previously described as field entries for the current trip. A favorite trip may be included in the top trips menu selection or included in the most recent trips menu selection. Favorite trips selections may automatically show as the first selection on any menu of field configurations.

Logger 16 may be configurable to allow user 12 to design a report for review. For example, the sports trainer of a previous example may want to be able to review the reasons for previous trips to an account. The trainer may configure logger 16 to display all trip records to a specific account and show the date and the reason for the trip. The trainer may view details of previous lessons in date order. Displaying trip records 22 allows the trainer to plan lessons and ensure that the customer at the account has been trained for an equal length of time in all the different skills (trip reasons), such as hitting practice, pitching practice and batting practice.

Trip logger 16 may provide the option of not logging mileage during a trip. Logger 16 in a no logging mode may not save reported vehicle positions from positioning system 29 in memory 38.

Logger 16 may include a volume control (not shown) that allows the user to increase or decrease the volume of audible prompts generated by the logger. Logger 16 may include a backlight that illuminates features on logger 16 such as display 34 and/or user inputs 36. The level of backlighting may be adjustable by the user. Logger 16 may automatically vary sound and light levels. Logger 16 may vary light levels in accordance with ambient light levels. Volume or sound levels may be adjusted in accordance with ambient sound levels. Logger volume levels may be associated with cell phone use by the user. Voice recognition sensitivity may be associated with ambient noise levels in vehicle 14.

Logger 16 may include a name generator. User 12 may visit a new account that has not been entered on the menu list as a selectable menu item. Logger 16 may be configured to supply a name that is unique and intuitive rather than a single letter. Logger 16 may generate names such as "LOGATE", "GNOMUS" or "FRAMBLE." The name generator may be configured to supply a large number of distinct names. User 12 may reconfigure the menu items at a later time to change the random name generated by the logger to the actual name of the account. Changing the name in the menu may change the name in all corresponding records. Generated names may be used in any and all fields.

Logger 16 may record a spoken name in an audio file to be used as a field entry. User 12 may put logger 16 into a recording mode for a specific field and speak the name of an account not already available as a menu item. Logger 16 may have voice to text capability to log a text entry corresponding to the audio file. Logger 16 may generate a random text name as described above that is indexed to the audio file to provide a text reference in the absence of another text reference.

Figure 7:
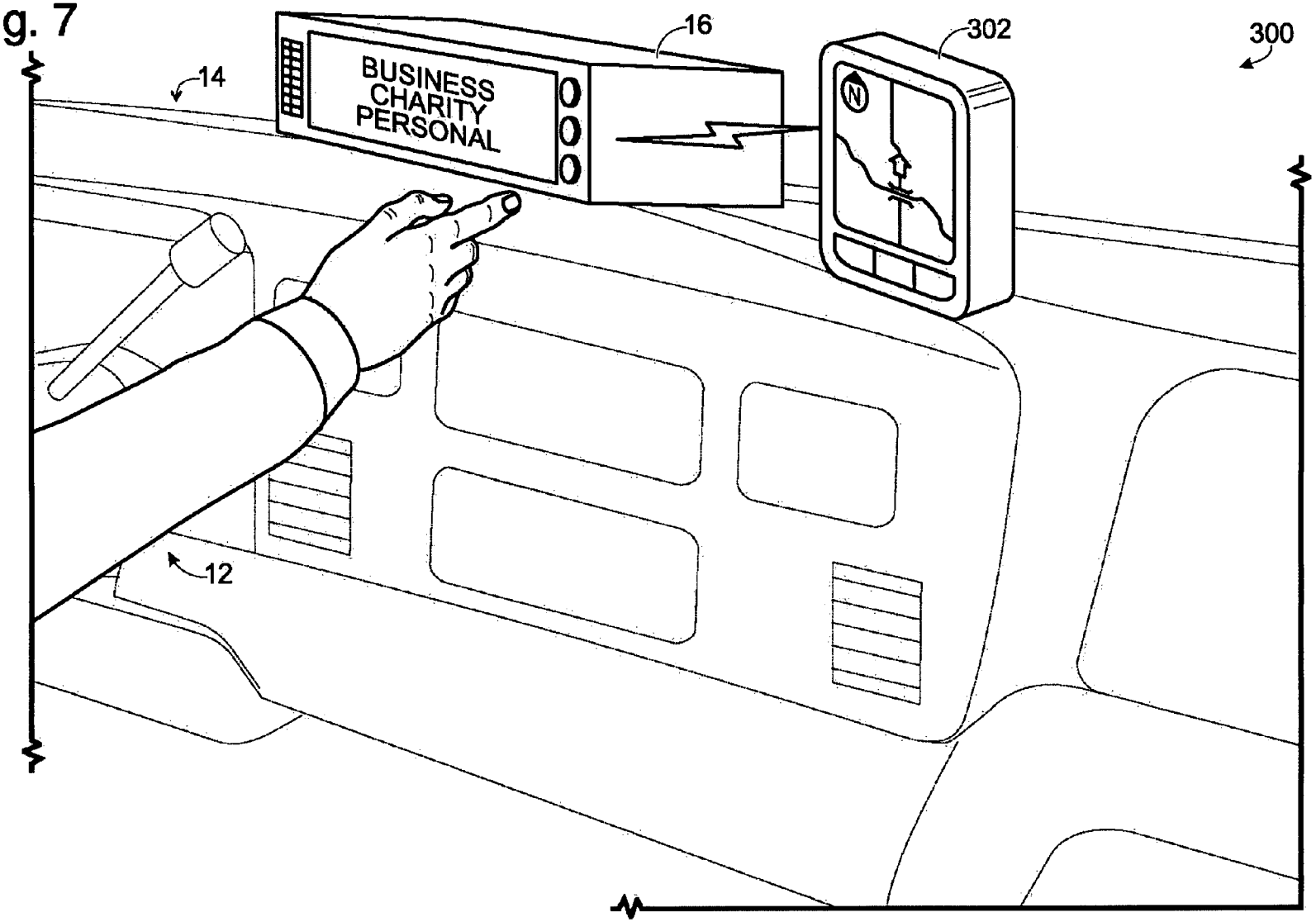
FIG. 7 is a perspective view of a trip logger being used in association with a navigation system.

In an alternate embodiment, data logger 16 may be configured to function with a separate navigation system 100 as shown in FIG. 7. Logger 16 may communicate with the navigation system and exchange data either through a cable or wirelessly. Logger 16 connects and communicates with navigation system 100 through I/O 40. In some embodiments, logger 16 may not include positioning system 29 and location data may be supplied by navigation system 100 to logger 16. Trip information may be supplied to navigation system 100 by logger 16. Trip information such as account names, trip fields and trip reasons may be entered at logger 16 and saved as records on logger 16 and/or on navigation system 100.

Similarly, logger 16 may be configured to operate in conjunction with a separate cell phone or PDA with positioning system capability. In this configuration, logger 16 may not have any positioning system capability itself and may communicate with the cell phone or PDA wirelessly or through a cable.

Trip logger 16 may have voice generation and/or voice recognition capabilities. Logger 16 may generate voice announcements for approaching landmarks or destinations. Landmarks may be saved into memory with a name, latitude and longitude coordinates and an audio file reference or index. When logger 16 determines by vehicle location that it is within a certain range of the landmark, logger 16 may identify an indexed audio file, retrieve the audio file of a voice announcement from memory and play the audio file. Logger 16 may retrieve multiple files in order to generate an appropriate announcement. Logger 16 may generate voice announcements for prompts.

Similarly, logger 16 may be able to recognize voice commands generated by the user. The user may announce when prompted that the trip field 26 for the trip is "Business." No further data entry may be required and the logger may enter "Business" as the field selection for trip field 26.

The user may be able to select the field and the menu selection using voice commands. The user may say "Trip field, Business, Reason Field, Golf Putting." Logger 16 may enter these menu selections in these fields based on the voice commands. Logger 16 may respond to other voice commands as well.

Logger 16 may respond to peripheral devices such as a laptop computer, a personal data assistant (PDA) or a cell phone. Peripheral device 42 may be wired to logger 16 or may maintain a wireless connection to logger 16. Peripheral device 42 may control functioning and configuration of logger 16. The device may upload data and software to logger 16 and/or the device may download information from logger 16 to the peripheral device.

Figure 8:
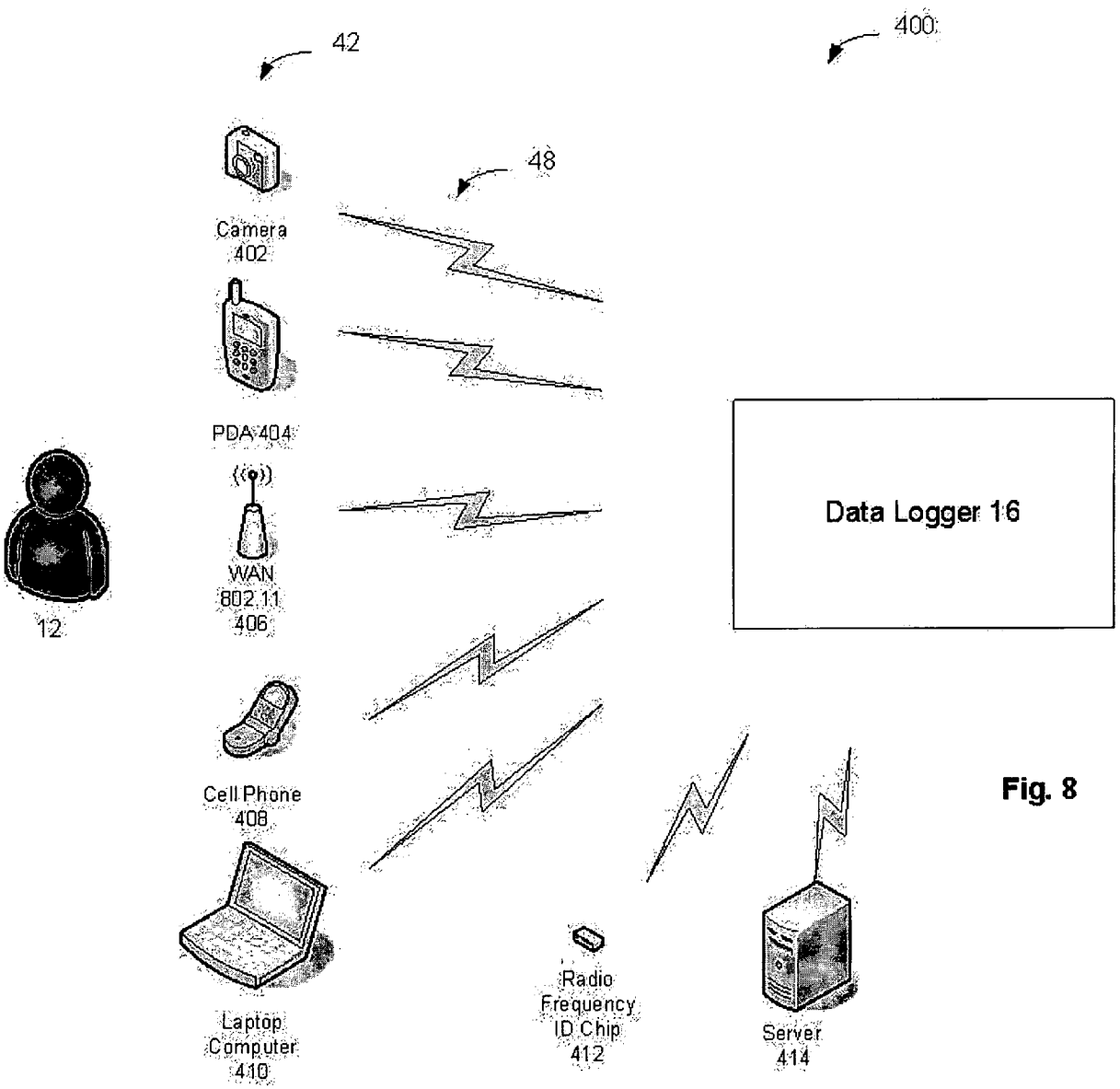
FIG. 8 is a perspective view of a trip logger used with a remote input device for providing input to the data logger located on the steering wheel.

FIG. 8 shows trip logger 16, user 12 and several embodiments of peripherals 42 that may communicate and exchange data and commands with logger 16. Peripherals 42 may include a camera 402, a PDA 404, a WLAN 802.11 access point 406, a cell phone 408, a laptop computer 410, Radio Frequency ID chip (RFID) 412 and/or a server 414. These are only examples and should not be considered limitations. Connections 48 between peripheral 42 and trip logger 16 may be wired or may be wireless. Wireless connections may use infrared, radio frequency, such as PAN or RFID, or other medium.

In an alternate configuration, positioning system 29 could be embodied in an accelerometer. A solid state accelerometer typically measures the deflection of a beam etched or cut into a substrate associated with an integrated circuit. By defining a starting point and measuring the acceleration in two or three coordinate directions, the location of a vehicle can continuously be determined along a trip route to provide latitude and longitude references similar to the coordinates determined by a GPS receiver.

Figure 9:
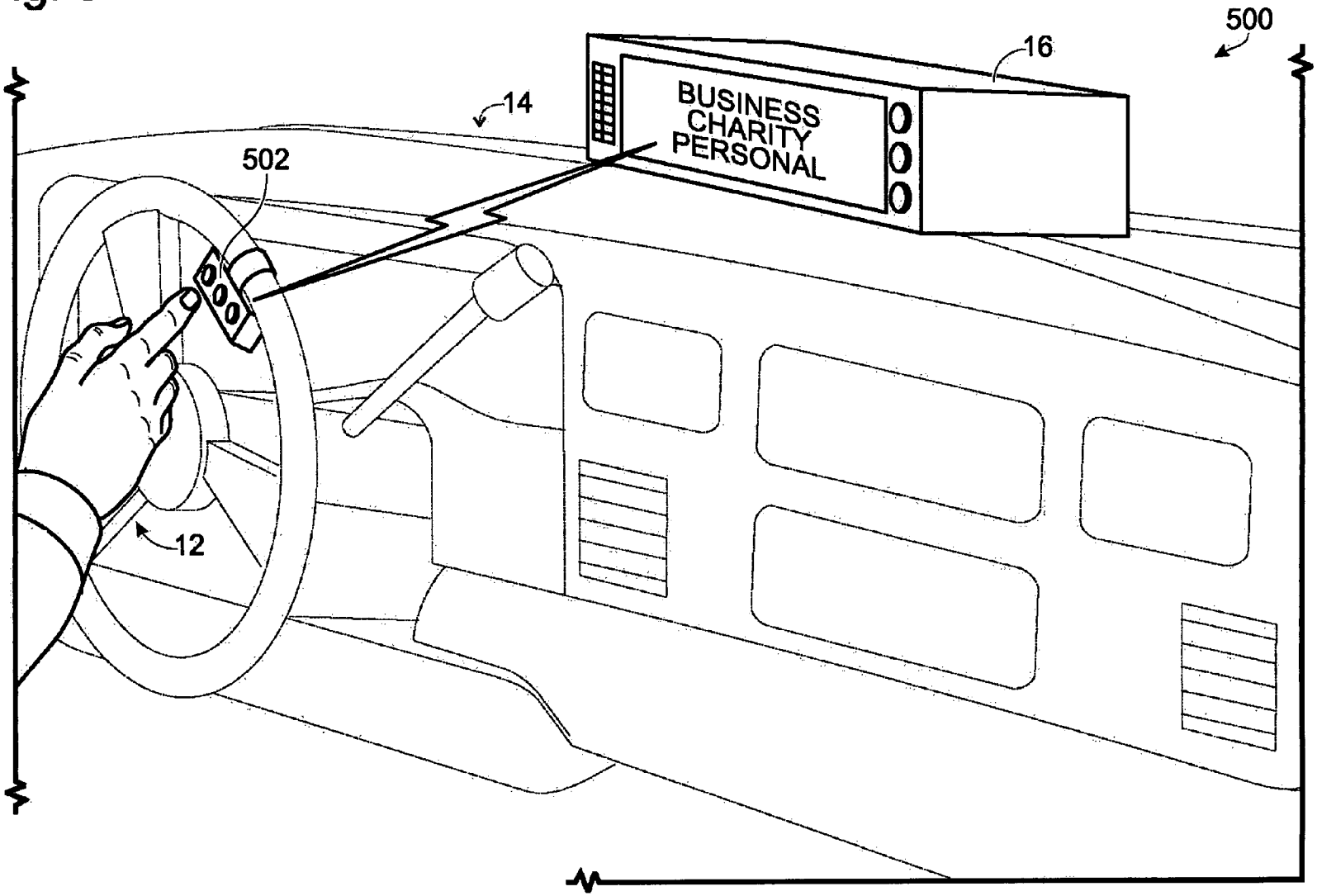
FIG. 9 is a diagram showing peripheral devices that may connect to the data logger and transfer data including a camera, a PDA, a WLAN access point, a cell phone, a laptop, an RFID tag and a server.

FIG. 9 shows trip logger 16 in use 500 including a remote input unit 502 secured to the steering wheel of vehicle 14. Remote input unit 502 may be located anywhere the user prefers and may have any number of inputs associated with it. Input unit 502 may allow user 12 to input commands and data to logger 16 without removing their hands from the steering wheel. Remote input unit 502 may use any wireless method to communicate with logger 16 such as infrared or PAN radio frequencies. Input unit 502 may be configured so that pressing a set of buttons will correspond to certain functions of logger 16. For example, pressing the first and third buttons may cause logger 16 to display top trips as previously described. The middle button may scroll down the trip list on display 34. Other buttons or combinations of buttons may initiate or execute additional functionality.

Data logger 16 may determine the acceleration of vehicle 14 in addition to other collected parameters. Acceleration data may be correlated with the maintenance of vehicle 14. Acceleration data may be used to maximize gas mileage of vehicle 14. In some embodiments, only acceleration above a certain threshold may be recorded. High levels of acceleration may be associated with lower fuel efficiency and/or higher maintenance costs. Data from logger 16 may be combined with information as to weather and road conditions to optimize maintenance of vehicle 14.

Data logger 16 may accept other input associated with a trip such as expenses or notations. Dollar amounts associated with a specific trip may be input at user input 36 or at the keys of a cell phone or PDA. Expenses or other notations may be included in trip records 28 or in another record with trip index 50 to associate the expense with the trip.

Logger 16 may have image acquisition capability such as a camera or a scanner. User 12 may hold up a receipt in front of logger 16 and enter a command to record the receipt. Logger 16 may photograph the receipt, store it as an image file and associate the image file with the current trip using trip index 50. Images from a camera may be uploaded to logger 16 using wireless capability such as Bluetooth. Uploaded images may be saved and associated with the current trip using trip index 50 or other association.

Display 34 may be a projector. Display 34 may project the display onto a screen, the car sun visor or it may be a heads-up display proximate to the windshield.

Although the invention has been described in detail for the purpose of illustration, it is to be understood that such detail is solely for that purpose, and variations can be made therein by those skilled in the art without departing from the spirit and scope of the invention, except as it may be limited by the claims.

Applicants regard the subject matter of their invention to include all novel and non-obvious combinations and subcombinations of the various elements, features, functions and/or properties disclosed herein. No single feature, function, element or property of the disclosed examples is essential to all examples. The following claims define certain combinations and subcombinations that are regarded as novel and non-obvious. Other combinations and subcombinations of features, functions, elements and/or properties may be claimed through amendment of the present claims or presentation of new claims in this or a related application. Such claims, whether they are different, broader, narrower or equal in scope to the original claims, are also regarded as included within the subject matter of applicants' invention.

We claim:

1. A trip logger system comprising:
- a vehicle used for travel; and
- a trip logger for recording travel in the vehicle including:
  - a housing;
  - a display for showing a plurality of menu items;
  - a user input for selecting at least one menu item as at least one field entry from the plurality of menu items;
  - memory for storing program instructions and records;
  - a positioning system configured to provide a time value and a location coordinate of the vehicle; and
  - a processor, operably connected to the display, the memory and the positioning system, the processor configured to:
    - create a plurality of records of a first type representing points along a path of vehicle travel, each record of the first type including a time value and a location coordinate of the vehicle provided by the positioning system;
    - create at least one record of a second type including:
      - the at least one selected field entry;
      - a vehicle start location entry; and
      - a vehicle end location entry; and
    - index at least two of the plurality of records of the first type to one record of the second type;
- where the trip logger identifies and deletes location records with redundant data.

2. The trip logger system of claim 1 where the processor is configured to randomly generate words to be displayed by the trip logger as menu items.

3. A data collection system to be used with vehicles comprising:
- a trip logger including:
  - a positioning system for determining vehicle location;
  - memory for recording vehicle location data collected by the positioning system;
  - a display for displaying a plurality of menu items;
  - a user input for selecting at least one menu item from the plurality of menu items; and a processor operatively connected to the positioning system, the memory, the user input and the display, the processor configured to create in the memory:

location records describing points on a trip path including vehicle location data from the positioning system; and a trip record indexed to a plurality of location records, each trip record comprising:

the at least one selected menu item;

a vehicle location reference to a start point of the trip path; and a vehicle location reference to an end point of the trip path; and a peripheral device configured to connect to the trip logger and transfer data between the peripheral device and the trip logger;

where the trip logger identifies and deletes location records with redundant data where remaining location records adequately define the trip path.

4. The data collection system of claim 3 where the processor is configured to randomly generate words to be displayed by the trip logger as menu items.

* * * * *